United States Patent [19]

Macocco et al.

[11] Patent Number: 4,938,689

[45] Date of Patent: Jul. 3, 1990

[54] FURNACE FOR FIRING WIRE-LIKE PRODUCTS

[75] Inventors: Dino Macocco, Venaria Reale; Michele Ricco', Collegno, both of Italy; Hans J. Reiser; Heinrich Wenker, both of Sulingen, Fed. Rep. of Germany

[73] Assignee: Societa' Industriale Costruzioni Microelettriche S.I.C.M.E. S.p.A., Turin, Italy

[21] Appl. No.: 149,860

[22] Filed: Jan. 29, 1988

[30] Foreign Application Priority Data

Jan. 30, 1987 [IT] Italy ..... 52926/87[U]

[51] Int. Cl.[5] ..... F27B 9/28

[52] U.S. Cl. ..... 432/59; 432/72

[58] Field of Search ..... 432/8, 59, 72, 125, 432/143, 148, 198; 126/108

[56] References Cited

U.S. PATENT DOCUMENTS

| | | | |
|---|---|---|---|
| 4,231,165 | 11/1980 | Gresons et al. | 432/72 |
| 4,303,387 | 12/1981 | Burke et al. | 432/59 |
| 4,448,578 | 5/1984 | Brunet et al. | 432/59 |
| 4,475,294 | 10/1984 | Henricks | 432/72 |
| 4,752,217 | 6/1988 | Justus | 432/59 |
| 4,856,986 | 8/1989 | Ricco et al. | 432/59 |

*Primary Examiner*—Henry C. Yuen

*Attorney, Agent, or Firm*—Gifford, Groh, Sprinkle, Patmore and Anderson

[57] ABSTRACT

A furnace for firing an enamel-insulated wire comprising a principal chamber, an auxiliary unit for withdrawing a first stream of air and solvent vapors from this principal chamber for effecting combustion of the vapors themselves. A part of a second stream leaving the auxiliary unit is mixed with a volume of air at ambient temperature and passed to the principal chamber; another part is sent to a heat exchanger in which it gives up part of its thermal energy to a second volume of air at ambient temperature which is heated and introduced into the principal chamber.

14 Claims, 1 Drawing Sheet

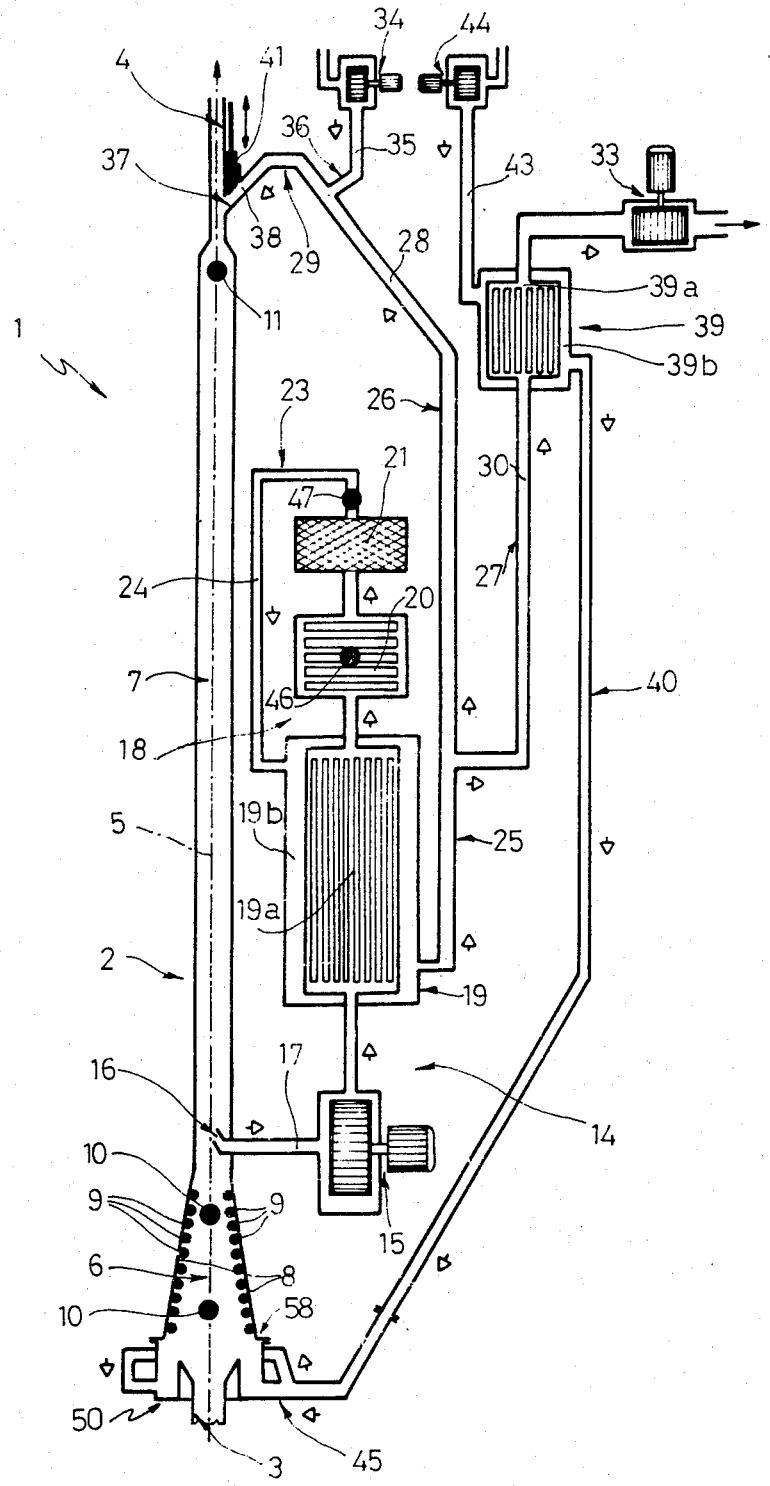
34
44
4
41
36
35
43
33
37
38
29
28
39a
39
39b
1
11
23
26
21
30
47
27
24
20
7
46
40
18
5
19b
25
19a
2
19
17
16
14
10
9
9
15
6
8
10
58
50
3
45

FURNACE FOR FIRING WIRE-LIKE PRODUCTS

BACKGROUND OF THE INVENTION

The present invention relates to a furnace for firing wire-like products, and in particular copper wires enamelled with a cladding of insulating plastics resin.

As is known, furnaces currently utilised for the firing the cladding of copper wires are of the continuous tunnel type, and include at least one chamber of elongate form in which the wire is caused to advance longitudinally. In a first portion of this chamber the solvents which impregnate the cladding resin are evaporated; in a second portion of the chamber, maintained at a temperature greater than that of the first portion, polymerisation and cross linking of the resin is effected.

Since the solvent vapours are pollutants the furnace generally includes an auxiliary unit which draws in a mixture of air and the said vapours at the end of the first portion of the chamber and passes it to a heating unit in which this mixture reaches the combustion temperature of the said vapours before being delivered to the chimney.

There are likewise known furnaces in which the said mixture, or at least a part of it, is further mixed with air at ambient temperature and a part of the new mixture thus obtained is reintroduced into the main chamber of the furnace to control its temperature, and a part is delivered to the chimney.

In both cases the mixture of gases delivered to the chimney has a relatively high energy content, and it is evident that the thermal energy thus dispersed must be regained by means of suitable heating elements.

SUMMARY OF THE INVENTION

The object of the present invention is the provision of a furnace for firing copper wires clad in plastics resin, which will be free from the said disadvantages, that is to say in which the emission of a stream of gases having a high energy content will be reduced as much as possible.

The said object is achieved by the present invention in that it relates to a furnace for firing wire-like products, in particular copper wires clad with plastics resin, of the type comprising:

a principal chamber of elongate form within which the said products translate axially in a longitudinal direction between an inlet opening and an oulet opening, the said principal chamber defining a first portion in which evaporation of solvents from the said plastics resin takes place and a second portion in which polymerisation and cross linking of the said plastics resin takes place;

an auxiliary unit including an aspiration opening communicating with the said principal chamber, means for drawing a first stream of air and solvent vapours from the said principal chamber and means for heating the said first stream to cause combustion of the said vapours;

first means for aspiration of a first volume of air from an external environment;

means for feeding a mixture of the said first volume of air and at least a first portion of a second stream leaving the said auxiliary unit to the said principal chamber; and means for feeding a second portion of the said second stream to a chimney;

characterised by the fact that it comprises:

second means for aspiration of a second volume of air from the external environment;

means for exchanging heat between at least the said second portion of the said second stream and the said second volume of air; and means for introducing the said second volume of air to the said principal chamber.

BRIEF DESCRIPTION OF THE DRAWING

For a better understanding of the present invention a preferred embodiment is hereinafter described purely by way of non-limitative example and with reference to the attached DRAWING, in which is schematically illustrated a furnace formed according to the principles of the invention.

DETAILED DESCRIPTION OF THE INVENTION

Generally indicated with the reference numeral 1 is a furnace for firing a cladding of insulating plastics resin on electrically conductive copper wires, which comprises, in a known way, a principal chamber 2 provided with an inlet opening 3 and an outlet opening 4, through which the wire 5 advances longitudinally in a continous manner. This chamber 2 has an elongate form and includes a first portion 6 the cross section of which increases towards th inlet opening 3, and a second portion 7 of substantially constant cross section. Along the side walls 8 of the first portion 6 are disposed heating elements 9, conveniently constituted by electrical resistors. Two thermocouples 10 housed in the said first portion 6, and a thermocouple 11 housed in the second portion 7 close to the outlet opening 4 detect the temperature in these portions and constitute the sensors of a temperature regulation system as described hereinbelow.

The furnace 1 further includes an auxiliary unit 14 disposed adjacent the principal chamber 2; this auxiliary unit 14 includes a fan 15 facing an induction opening 16 communicating with the principal chamber 2 close to the section joining the two portions 6, 7 of the chamber 2 itself, which acts to draw in a first stream 17 of a mixture of air and solvent vapours produced in the first portion 6, and a heating assembly 18. This heating assembly 18 is constituted by a heat exchanger 19, an electrical resistance heater 20, and a catalytic plate combustion chamber 21. A primary circuit **19*a* of the heat exchanger 19, the heater 20 and the combustion chamber 21 are disposed in series downstream of the fan 15. A duct 23 carries a second stream 24 from the combustion chamber 21 to a secondary circuit 19*b* of the heat exchanger 19, in counter-current with respect to the primary circuit 19*a*, in such a way as to preheat the first stream 17 arriving at the heater 20**.

Two ducts 26, 27 extend from an outlet duct 25 leading from the auxiliary unit 14; these two ducts convey a first portion 28 of the second stream 24 towards a recirculation duct 29 leading to the second portion 7 of the chamber 2, and a second portion 30 towards a fan 33 which directs it to the chimney.

A fan 34 draws in a first volume of air 35 from the outside and passes it along a duct 36 which leads, together with the duct 26, into the recirculation duct 29 which opens into the second portion 7 of the principal chamber 2 through an aperture 37 closable by a gate valve 41; the arrangement of the recirculation duct 29 is such as to introduce a third stream 38 resulting from the mixture of the first portion 28 of the second stream 24 with the said first volume of air 35 in a direction substantially opposite the direction of advancement of the wire 5.

According to the present invention the furnace 1 includes a second heat exchanger 39 a primary circuit 39*a* of which is disposed in series with the said duct 27, and a secondary circuit 39*b* of which , flowing in counter current with respect to the first, is disposed in series with a duct 40 which conveys a second volume of air 43 from a fan 44, which draws it from the external environment, to an introduction opening 45 in the first portion 6 of the principal chamber 2.

This opening 45 is shaped in such a way that the air 43 is introduced into the first portion 6 from several sides and in a direction substantially parallel to the side walls 8 of the portion 6 itself, as is schematically indicated in the drawing and is illustrated and described in detail in the patent application for industrial utility model entitled "Vertical furnace for firing wire-like products" filed on the same date by the same Applicant, and the content of which is introduced here by reference for the necessary parts.

Two further thermocouples 46, 47 are disposed respectively in the heater 20 and at the outlet of the combustion chamber 21.

The operation of the furnace 1 is as follows.

The wire 5 enters into the principal chamber 2 through the inlet opening 3 and passes through the first portion 6 in which evaporation of the solvents from the resin which constitutes the cladding thereof takes place; it then passes into the second portion 7, maintained at a temperature greater than that of the portion 6, in which polymerisation and cross linking of the resin take place.

A first stream 17 drawn by the fan 15 and delivered to the heating unit 18 is substantially constituted by a mixture of air and solvent vapours. This mixture is first preheated by the heat exchanger 19 and then raised by the heater 20 to a temperature sufficient to initiate the combustion of the said vapours. The catalytic plate combustion chamber 21 facilitates complete oxidation of these vapours into harmless combustion products (carbon dioxide and steam), which constitute, together with possible excess air, the said second stream 24 which gives up part of its thermal energy to the first stream 17 in the heat exchanger 19.

This second stream 24 is then divided. The first portion 28, mixed with the air 35 drawn in by the fan 34, is introduced in counter current into the second chamber 7 for the dual purpose of controlling its temperature, in dependence on the values detected by the thermocouple 11, and of preventing a heavy flow of hot fluid through the outlet opening 4 by the chimney effect. These effects are controllable both by suitably throttling the aperture 37 by means of the valve 41, and by varying the speed of the fan 34 and therefore the rate of flow of cold air 35.

The second portion 30 of the second stream 28 gives up the greatest possible part of its thermal energy to the air 43, and is then sent to the chimney at a relatively low temperature. The air 43, which in this way can achieve temperatures of the order of 380° to 600° C., is introduced into the first portion 6 of the principal chamber 2, with the dual function of re-utilising the thermal energy of the second portion 30 of the stream 24 which would otherwise have been lost, thus obtaining a heat recovery of the order of 10000–80000 Kcal/Hour with a flow rate of 80–60 Nm/Hour, and with a reduced intake of cold air by the chimney effect through the inlet opening 3.

These effects are controlled, in dependence on the signals from the thermocouples 10, by varying the speed of the fans 44 and 33, that is by varying the rate of flow of the second portion 30 of the second stream 24 and of the cold air 43. Similarly, depending on the temperature values detected by the thermocouples 10, 46, 47, the rate at which heat is supplied by the heating elements 9 and by the heating unit 18, as well as the rate of flow of the first stream 17 are varied.

From a study of the characteristics of the furnace 1 formed according to the present invention, the advantages which it allows to be obtained are evident. First of all, the flow of fluid at high temperature towards the outside is very much reduced. In particular, the heat exchanger 39 allows the major part of the thermal energy of the second portion 30 of the second stream 24 to be recovered, and the reintroduction of the mixture 38 in counter current resists the escape of hot fluid from the outlet opening 4 of the principal chamber 2.

In this way, the introduction of heat energy by the heating elements 9 and the heater 20 is reduced; a further energy saving is obtained by the fact that the induction of cold air from the inlet opening 3 by the chimney effect is minimised thanks to the introduction of the heated air 43.

Finally, it is clear that the furnace 1 described can have modifications and variations introduced thereto without by this departing from the protective scope of the present invention. In particular, the heat exchanger 19 and/or the heating elements 9 can be omitted; the temperature in the first portion 6 of the principal chamber 2 can then be controlled exclusively by the flow of heat provided by the air 43. Further, the points at which fluid is withdrawn and introduced into the principal chamber 2 can be varied. The heater 20 can be of any convenient type, for example a gas burner.

Finally, the furnace 1 can include two or more adjacent principal chambers 2 operating over different temperature ranges and the wire 5 can be guided by suitable guide means to pass several times through one or the other of the principal chambers 2

We claim:

1. A furnace for firing wire-like products, in particular copper wires clad with plastics resin, of the type comprising:

a principal chamber of elongate form within which the said products translate axially in a longitudinal direction between an inlet opening and an oulet opening, the said principal chamber defining a first portion in which evaporation of solvents from the said plastics resin takes place and a second portion in which polymerisation and cross linking of the plastics resin take place:

an auxiliary unit comprising an induction opening communicating with the said prinicipal chamber, means for drawing a first stream of air and solvent vapours from the said principal chamber and means for heating the said first stream to cause combustion of the said vapours;

first aspiration means for drawing a first volume of air from an external environment;

means for introudcing into the said principal chamber a mixture of the said first volume of air and at least a first portion of a second stream leaving the said auxiliary unit; and means for delivering a second portion of the said second stream to a chimney;

second aspiration means (44) for drawing a second volume of air (43) from the external environment;

heat exchange means (39) for exchanging heat between at least a second portion (30) of the said second stream (24) and the said second volume of air (43); and means (40, 45) for introducing the said second volume (43) of air to the said principal chamber (2).

2. A furnace according to claim 1, wherein said heat exchange means include a heat exchanger (39) a primary circuit (39*a*) of which is connected in series to the said means (27) for introducing the said second portion (30) of the said second stream (24) to the chimney, and a secondary circuit (39*b*) of which is connected in series with the said second aspiration means (44) and to the said means (40) for introducing the said second volume (43) of air.

3. A furnace according to claim 1 wherein said means (40, 45) for introducing the said second volume (43) of air to the said principal chamber (2) includes an introduction opening (45) communicating with the said first portion (6) of the said principal chamber (2).

4. A furnace according to claim 3, wherein said opening (45) introduces the said second volume (43) into the said first portion (6) of the said principal chamber (2) from several sides along a lateral surface (8) of the said first portion (6) and in a direction substantially parallel to the said surface (8).

5. A furnace according to claim 2, wherein said heat exchanger (39) effects an exchange of thermal energy of a value lying between 10000 and 800000 Kcal/Hour with flow rates of fluid (30, 43) lying between 80 and 600 Nm/Hour, and in that the said second volume (43) of air reaches a temperature lying between 380° and 600° C.

6. A furnace according to claim 1, wherein said means for introducing the said mixture (38) of the said first volume (35) of air and the said first portion (28) of the said second stream (24) comprise a duct (29) communicating with the said second portion (7) of the said principal chamber (2).

7. A furnace according to claim 6, wherein said duct (29) communicates with the said second portion (7) of the said principal chamber (2) through an aperture (37) closable by flow rate limiter means (41).

8. A furnace according to claim 7, wherein said flow rate limiter means comprises a gate valve (41).

9. A furnace according to claim 6, wherein said duct (29) introduces the said mixture (38) into the said second portion (7) close to the said outlet opening (4) of the said principal chamber (2) and in a direction substantially opposite to the direction of advance of the said wire (5) in the said principal chamber (2).

10. A furnace according to claim 1, further including heater means (9) housed in the said first portion (6) of the said principal chamber (2).

11. A furnace according to claim 1, wherein said heating means (20) of the said auxiliary unit (14) include at least one electric resistor.

12. A furnace according to claim 1, wherein said heating means (20) of the said auxiliary unit (14) include at least one gas burner.

13. A furnace according to claim 1, wherein said heating means (18) of the said auxiliary unit include heat exchange means (19) for exchanging heat between the said second stream (24) and the said first stream (17).

14. A furnace according to claim 1, wherein said heating means (18) includes a catalytic plate combustion chamber (21).

* * * * *